US005260623A

United States Patent [19]

Bradatsch

[11] Patent Number: 5,260,623

[45] Date of Patent: Nov. 9, 1993

[54] ELECTRON COLLECTOR FOR AN ELECTRON BEAM TUBE

[75] Inventor: Hubert Bradatsch, Neu-Ulm, Fed. Rep. of Germany

[73] Assignee: Licentia Patent-Verwaltungs-GmbH, Frankfurt am Main, Fed. Rep. of Germany

[21] Appl. No.: 844,840

[22] Filed: Mar. 3, 1992

[30] Foreign Application Priority Data

Mar. 23, 1991 [DE] Fed. Rep. of Germany ..... 4109664

[51] Int. Cl.[5] ..... H01J 1/42; H01J 23/033

[52] U.S. Cl. ..... 313/40; 313/44; 313/45

[58] Field of Search ..... 313/45, 40, 44

[56] References Cited

U.S. PATENT DOCUMENTS 2,285,662 6/1942 Hutcheson ..... 313/45 X
3,448,313 6/1969 Boilard et al. .
3,963,952 6/1976 Orui et al. ..... 313/45

FOREIGN PATENT DOCUMENTS 193507 11/1957 Fed. Rep. of Germany ..... 313/45
3138883C2 5/1990 Fed. Rep. of Germany .
0376827 7/1990 France .

OTHER PUBLICATIONS

*Rundfunktechnischi Mitteilungen* Radio Technology (1971) pp. 141–148.

*Primary Examiner*—Palmer C. DeMeo
*Attorney, Agent, or Firm*—McGlew & Tuttle

[57] ABSTRACT

An electron-beam tube with an electron collector for an electron-beam entering the electron collector in an electron-beam direction. A plurality of large-area projections are provided for heat radiation including a funnel-shaped projection expanding in the electron-beam direction. The funnel-shaped projection includes a smaller opening which is one of directly and indirectly fastened to the collector and including an upstream projection including a surface which is first with respect to the electron-beam direction, the surface facing the arriving electron-beam and the surface being provided with low heat radiation properties. All other surfaces of the plurality of projections having high heat radiation properties higher than the low heat radiation properties. The collector and the plurality of projections being supported by a satellite as a travelling-wave tube with the electron collector radiating into space.

19 Claims, 1 Drawing Sheet

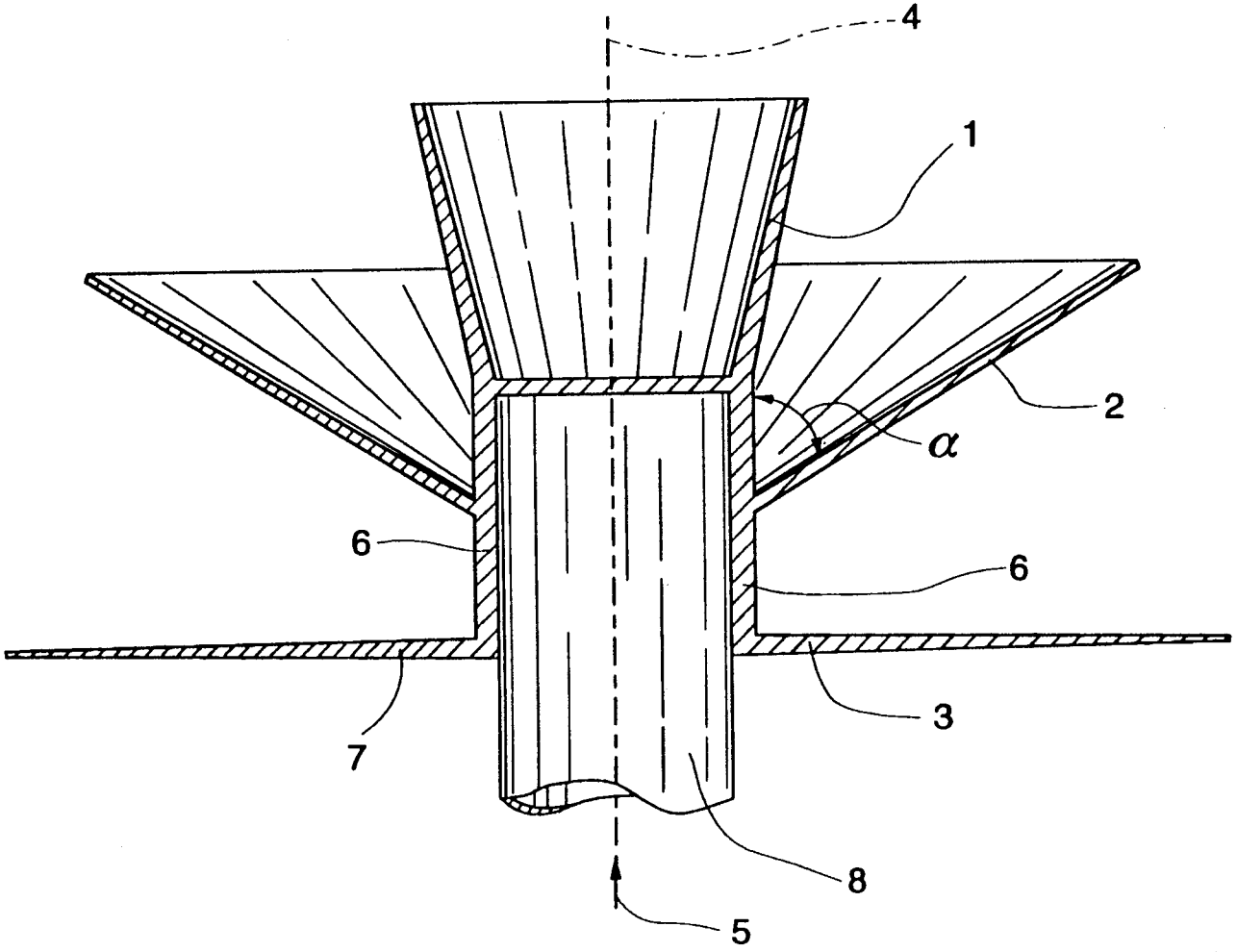
4
1
2
α
6
3
8
5
6
7

ELECTRON COLLECTOR FOR AN ELECTRON BEAM TUBE

FIELD OF THE INVENTION

The present invention pertains to an electron-beam tube such as an electron-beam tube for use in a satellite with an electron collector and more particularly to an electron-beam tube with an electron collector, having a surface with at least one large-area projection for heat radiation.

BACKGROUND OF THE INVENTION

An electron-beam tube with electron collectors is known in the art wherein an projection is provided for heat radiation e.g., EP 3,76,827 A1.

SUMMARY AND OBJECTS OF THE INVENTION

It is an object of the invention to improve the directed heat emission of an electron collector of such an electron-beam tube.

According to the invention, an electron-beam tube is provided with an electron collector, having a surface with at least one large-area projection for heat radiation. For improving the directed heat emission of the electron collector, the projection is formed as a funnel-shaped projection expanding in an electron-beam direction. The funnel-shaped projection is either directly or indirectly fastened to the collector at the smaller opening of the funnel-shaped projection.

According to a variant of the invention, at least two funnel-shaped projections are provided. The funnel-shaped projection or the two funnel-shaped projection form part of a cooling body which is fastened to the electron collector.

The projection may be provided with surfaces wherein only the surface that is first in the electron-beam direction, which surface faces the arriving electron-beam, has a low heat radiation whereas all other surfaces of the projection or projections are designed as surfaces with good heat radiation.

According to another feature of the invention, an envelope defined by the outer circumferential surfaces of the projections is a curved shell surface and more particularly is provided as an approximately spherical shell surface. The projections may be in the form of a plurality of funnel-shaped projections whose opening angles ($\alpha$) are different. These opening angles ($\alpha$) preferably decrease considerably in the electron-beam direction.

The electron-beam tube of the invention is preferably designed as a traveling-wave tube with an electron collector radiating into space.

The electron-beam tube of the invention is preferably performed with a cooler support made of aluminum or an aluminum alloy arranged with good thermal conduction, applied on an electron collector. The electron collector preferably consists of copper or a copper alloy. The funnel-shaped projections may be directly fastened to the surface of the collector or may be connected in one piece with the collector and preferably the projections are connected with the cooler support. The funnel-shaped projections preferably consist of copper or a copper alloy. The projections may be mechanically braced or supported with additional brace elements.

The funnel-like, i.e., truncated cone jacket-like shape of the heat-emitting projections brings about directed emission of heat predominantly in the direction of the electron beam entering the electron collector. Electron-beam tubes intended for use in satellites, e.g., traveling-wave tubes, are preferably mounted in a satellite so that their electron connector, whose temperature rises due to absorption of the highly accelerated electrons, projects from the outer wall of the satellite, so that the heat is emitted into space. The heat radiation is substantially improved if the radiation is directed, to the extent possible, away from the satellite.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The only FIGURE is a partially cross sectional view of an electron collector with cooling body and heat-emitting projections according to the invention.

DETAILED DESCRIPTION OF THE PREFERRED EMBODIMENT

The present invention will be explained in greater detail below based on the exemplified embodiment shown in the FIGURE. The FIGURE shows a cooling body 6 made of metal, which itself has the lowest possible weight and the highest possible thermal conductivity, and is arranged on an electron collector 8 of a satellite traveling-wave tube. The said cooling body 6 has two funnel-shaped, i.e., truncated cone-shaped projections 1 and 2, which expand in the direction 5 of the electron beam entering the said collector 8 and have different opening angles alpha. The opening angles alpha decrease in the electron beam direction 5, i.e., the said truncated cone-shaped jacket 1 has a smaller opening angle alpha than the said truncated cone-shaped jacket 2 located in front of it.

Another, annular disk-shaped cooling projection 3 is arranged on the end of the said cooling body 6 facing the arriving electron beam. However, the said cooling ring 3 may also be a truncated cone-shaped jacket, with an opening angle alpha that is larger than that of the said cooling projection 2, but preferably somewhat smaller than 90 degrees.

The outer circumferences of the said projections 1, 2 and 3 (an envelope formed by the outer ends of the projections) are preferably selected to be such that the envelope forms a shell, especially an approximately spherical shell. The said collector 8 with the said cooler support 6 is designed essentially rotationally symmetrically to the longitudinal axis 4 of the tube. If desired, the said cooling projections 1, 2 and 3 may also be arranged or fastened directly on the outer surface of the said collector 8.

However, it is advantageous, in general, for the said projections 1, 2 and 3 to form part of a cooler support 6, which is fastened, with good thermal conduction, on the said collector 8.

All surfaces of the said projections 1, 2 and 3, with the exception of the surface 7 of the said projection 3 located closet to the arriving electron beam 5, which latter surface faces the said arriving electron beam 5, are characterized by high heat emission ($E_r>0.9$). In contrast, the said surface 7 of the projection, which surface faces the arriving electron beam, is designed as a surface with low heat emission ($E_r<0.05$). These heat emission characteristics are preferably achieved by appropriate treatment and/or coating.

For example, in order to make the surface 7 of the projection 3 lightly thermally radiated, the surface 7 may be coated bright and smooth, or on the other hand, gleamingly glassed. In order to make the other surfaces of the projections 1, 2, 3 strongly thermally-radiated, these surface areas can be coated darkly, as for example, with a black sooty coating or these surface may be blanketed with a carbon coating.

The said electron collector 8 preferably consists of copper, which has good thermal conductivity, or a copper alloy. The said cooling body 6 with the said projections 1, 2 and 3 consists of a metal with good thermal conductivity. It should have the lowest possible weight and may consist of, e.g., aluminum or a light metal alloy. The said projections 1, 2 and 3 may also consist of, e.g., copper of small cross section. It is advantageous in this case to provide additional braces in order to increase the mechanical stability of the said funnel-shaped projections 1, 2 and 3.

While specific embodiments of the invention have been shown and described in detail to illustrate the application of the principles of the invention, it will be understood that the invention may be embodied otherwise without departing from such principles.

What is claimed is:

1. In an electron beam tube having an electron collector for an electron beam entering the electron collector in an electron beam direction, the improvement comprising a plurality of large-area projections for heat radiation including a funnel-shaped projection expanding in said electron-beam direction, said funnel-shaped projection including a smaller opening side which is one of directly and indirectly fastened to said collector and including an upstream projection including a surface which is first with respect to said electron-beam direction, said surface facing the arriving electron-beam, said surface being provided with low heat radiation properties and all other surfaces of said plurality of projections having high heat radiation properties, higher than said low heat radiation properties, said collector and said plurality of projections being supported by a satellite as a travelling-wave tube with said electron collector radiating into space.

2. An electron-beam tube according to claim 1, wherein two funnel-shaped projections are provided.

3. An electron-beam tube according to claim 2, wherein said two funnel-shaped projections form a part of a cooling body fastened to said electron collector.

4. An electron-beam tube according to claim 3, wherein said cooling body includes a cooler support formed of one of aluminum and an aluminum alloy and is arranged with good thermal conduction, applied to said electron collector, said electron collector formed of one of copper and a copper alloy.

5. An electron-beam tube according to claim 2, wherein an envelope defined by outer ends of said projections forms a curved shell surface, especially an approximately spherical shell surface.

6. An electron-beam tube according to claim 2, wherein said plurality of funnel-shaped projections are provided with opening angles ($\alpha$) which are different.

7. An electron-beam tube according to claim 6, wherein said opening angles ($\alpha$) decrease considerably in the electron-beam direction.

8. An electron-beam tube according to claim 2, wherein said funnel-shaped projections are directly fastened to a surface of said collector.

9. An electron beam tube according to claim 8, wherein said funnel-shaped projections are formed of copper or a copper alloy.

10. An electron-beam tube according to claim 2, wherein said projections are mechanically braced or supported with additional braces.

11. In an electron beam tube having an electron collector for an electron beam entering the electron collector in an electron beam direction, the improvement comprising a cooling body including a large-area projection for heat radiation, said projection being formed as a funnel-shaped projection expanding in said electron-beam direction and including a smaller opening side directly or indirectly fastened to said collector; and a cooler support connected to said cooling body, said cooler support formed of one of aluminum and aluminum alloy, said cooler support being arranged with good thermal conduction, applied to said electron collector, said electron collector being formed of one of copper and a copper alloy.

12. An electron-beam tube according to claim 11, wherein two funnel-shaped projections are provided fastened to said cooler support.

13. An electron-beam tube according to claim 12, wherein said two funnel-shaped projections are provided with opening angles (d) which are different.

14. In an electron beam tube having an electron collector for an electron beam entering the electron collector in an electron beam direction wherein said tube is supported by a satellite as a travelling wave tube, the improvement comprising a cooling body including two funnel-shaped projections, each of said funnel-shaped projections expanding in said electron-beam direction; and an additional projection including a first surface which is first with respect to said electron-beam direction which surface faces the arriving electron-beam, said first surface being provided with low heat radiation properties whereas all other surfaces of said cooling body being formed with high heat radiation properties, higher than said low heat radiation properties; and a cooler support connected to said two funnel-shaped projections and said additional projection, said cooler support being connected in good thermal conduction with said electron collector.

15. An electron-beam tube according to claim 14, wherein an envelope defined by outer ends of said projections forms a curved shell surface, particularly defining a spherical shell surface.

16. An electron-beam tube according to claim 14, wherein said collector, said cooling body, and said cooler support as supported by a satellite as a travelling-wave tube with said electron collector radiating into space.

17. An electron-beam tube according to claim 14, wherein said two funnel-shaped projections are provided with different opening angles, wherein said opening angles decrease in the electron-beam direction.

18. An electron-beam tube according to claim 14, wherein said cooler support is formed of one of aluminum and aluminum alloy, and said electron collector is formed of one of copper and copper alloy.

19. An electron-beam tube according to claim 14, wherein said funnel-shaped projections are formed of copper or a copper alloy.

* * * * *